US007372426B2

(12) United States Patent
Fukuda

(10) Patent No.: US 7,372,426 B2
(45) Date of Patent: May 13, 2008

(54) ANTENNA DEVICE AND RADIO COMMUNICATION APPARATUS

(75) Inventor: Junichi Fukuda, Tokyo (JP)

(73) Assignee: NEC Corporation, Tokyo (JP)

( * ) Notice: Subject to any disclaimer, the term of this patent is extended or adjusted under 35 U.S.C. 154(b) by 58 days.

(21) Appl. No.: 11/283,698

(22) Filed: Nov. 22, 2005

(65) Prior Publication Data

US 2006/0109180 A1 May 25, 2006

(30) Foreign Application Priority Data

Nov. 24, 2004 (JP) ..... 2004-338265

(51) Int. Cl.

| | |
|---|---|
| ***H01Q 1/50*** | (2006.01) |
| ***H01Q 1/24*** | (2006.01) |
| ***H01Q 3/24*** | (2006.01) |
| ***H01Q 1/38*** | (2006.01) |

(52) U.S. Cl. ..... 343/850; 343/700 MS; 343/702; 343/850; 343/876; 343/845

(58) Field of Classification Search ..... 343/700 MS, 343/850, 845, 702, 876
See application file for complete search history.

(56) References Cited

U.S. PATENT DOCUMENTS

| | | | | |
|---|---|---|---|---|
| 4,538,153 A | | 8/1985 | Taga | |
| 5,714,961 A | | 2/1998 | Kot et al. | |
| 5,880,694 A | * | 3/1999 | Wang et al. | 343/700 MS |
| 6,252,553 B1 | * | 6/2001 | Solomon | 343/700 MS |
| 2004/0189537 A1 | * | 9/2004 | Kinuzawa et al. | 343/702 |

FOREIGN PATENT DOCUMENTS

| | | |
|---|---|---|
| JP | 2000-312112 A | 11/2000 |

OTHER PUBLICATIONS

McEwan et al.:"Compact WLAN Disc Antennas"IEEE Transactions on Antennas & Propagation,IEEE Service Center,vol. 50,No. 12,(Dec. 2002)p. 1862-1864.

* cited by examiner

*Primary Examiner*—Douglas W. Owens
*Assistant Examiner*—Robert Karacsony
(74) *Attorney, Agent, or Firm*—Sughrue Mion, PLLC

(57) ABSTRACT

An antenna device includes an antenna main body having at least three electricity feeding points and a feeder circuit for feeding an electrical signal to the antenna main body. The feeder circuit feeds electrical signals different in at least one of amplitude and phase to the electricity feeding points. The device enables to control the directivity with the use of a single antenna.

9 Claims, 5 Drawing Sheets

| | ELECTRICITY FEEDING POINT 15-1 | ELECTRICITY FEEDING POINT 15-2 | ELECTRICITY FEEDING POINT 15-3 | BEAM DIRECTION |
|---|---|---|---|---|
| CASE 1 | 180 | 0 | 0 | 180 |
| CASE 2 | 0 | 180 | 0 | 300 |
| CASE 3 | 0 | 0 | 180 | 60 |

FIG.3

ANTENNA DEVICE AND RADIO COMMUNICATION APPARATUS

BACKGROUND OF THE INVENTION

1. Field of the Invention

The present invention relates to an antenna device, and more particularly to an antenna device capable of controlling its directivity, and a radio communication apparatus using the antenna device.

2. Description of the Related Art

Most mobile communication terminals use a nondirectional antenna as an antenna device, because the direction toward a base station to be communicated with always changes. Meanwhile, in recent years, cellular phones, as an example of mobile communication terminals, have come to have a large number of functions. Those functions include website browsing, video telephone, photographing still images or moving images, navigation using the global positioning system, and authentication and checkout using a radio frequency identification technique. In order to implement such various functions, excellent antenna characteristics must be maintained irrespective of the use states of the cellular phones.

Known as antennas for improving antenna characteristics are diversity antennas, array antennas, Yagi-Uda antennas, patch antennas, and the like. In particular, as disclosed in JP 2000-312112A, a single patch antenna can form a desired radiation area. The patch antenna has a first electricity feeding point and a second electricity feeding point on an X-axis and a Y-axis, respectively, the X-axis and the Y-axis being orthogonal to each other on a conductor patch. Electrical signals fed to these electricity feeding points are different in at least one of amplitude and phase. The patch antenna resonates in directions parallel to the X-axis and also parallel to the Y-axis. As a result, the radio wave of a radio signal, which includes two types of linear polarization orthogonal to each other having the same resonance frequency, is radiated in a Z-axis direction which is opposite to a grounded conductor.

In the patch antenna, vertical polarization and horizontal polarization are always orthogonal to each other, and the direction of the directivity is always in the vertical direction (z-axis direction). Accordingly, in the patch antenna, only the polarization planes change, and the direction of the directivity does not change. In the case of patch antenna, plural patch antennas are arranged in an array in order to incline the direction of the directivity from the vertical direction to the horizontal direction. It is difficult to change the direction of the directivity with the use of only a single patch antenna.

On the other hand, a compact patch antenna having one electricity feeding point is disclosed in the following document: "Compact WLAN Disc Antennas" written by Neil J. McEwan, Raed A. Abd-Alhameed, Embarak M. Ibrahim, Peter S. Excell, and Nazar T. Ali, IEEE transactions on antennas and propagation, vol. 50, No. 12, December 2002. It is also difficult for this antenna to change the directivity.

SUMMARY OF THE INVENTION

An object of the present invention is to provide an antenna device, which is capable of controlling its directivity, and is small in size, and a radio communication apparatus having the antenna device.

The antenna device includes an antenna main body having at least three electricity feeding points and a feeder circuit for feeding an electrical signal to the antenna main body. The feeder circuit feeds electrical signals different in at least one of amplitude and phase to the electricity feeding points. A radio communication apparatus has a transmission and reception section, an antenna device. The antenna device includes the antenna main body having at least three electricity feeding points and the feeder circuit for feeding an electrical signal to the antenna main body.

The feeder circuit feeds electrical signals different in at least one of amplitude and phase to the electricity feeding points.

In the invention, it is possible to control the directivity with the use of a single antenna. Further, the use of a single antenna allows the antenna device to be so small that the antenna device can be built in cellular phones or the like. Furthermore, it is possible to optimally set the directivity according to communication states.

BRIEF DESCRIPTION OF THE DRAWINGS

The above and other objects, features and advantages of the present invention will become apparent from the following detailed description when taken with the accompanying drawings in which:

FIG. 3 shows an operation example of an antenna device according to the embodiment of the present invention;

DETAILED DESCRIPTION OF THE PREFERRED EMBODIMENT

Figure 1A:
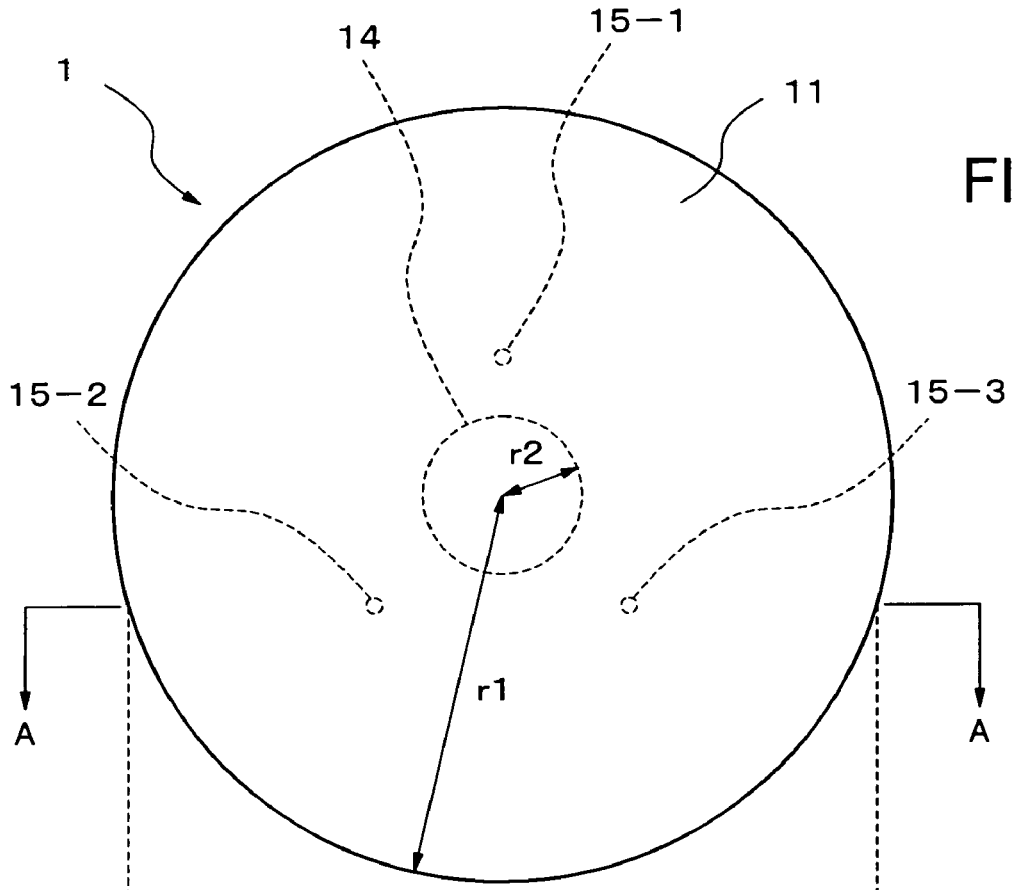
FIGS. 1A and 1B are a plan view and a cross sectional view, respectively, showing an antenna main body according to an embodiment of the present invention.
Figure 1B:
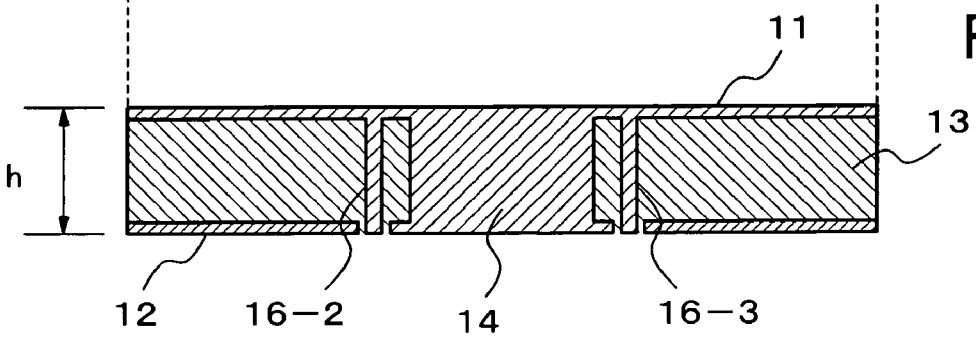

Hereinafter, a preferred exemplary embodiment of the present invention will be described. An antenna device according to the example of the present invention includes an antenna main body 1 having plural layers, and a feeder circuit 2 for feeding an electrical signal to the antenna main body 1. Referring to FIGS. 1A and 1B, the antenna main body 1 has an antenna element 11 serving as an upper layer, a ground layer 12 serving as a lower layer, and a dielectric layer 13 disposed between the upper layer and the lower layer. Disposed on the antenna element 11 are three electricity feeding points 15-1, 15-2, and 15-3. The antenna main body 1 is a patch antenna having a planar inverted-F antennas structure. The antenna main body 1 further includes: a cylindrical conductor 14, namely, a center post, for connecting a center part of the antenna element 11 to a center part of the ground layer 12; and three feeder conductors 16-1, 16-2, and 16-3 which are respectively provided for the electricity feeding points 15-1, 15-2, and 15-3 and connected to the antenna element 11. As shown in FIG. 1A, the antenna main body 1 has a disc shape. The feeder conductors 16-1, 16-2, and 16-3 are not connected to the ground layer 12. The electricity feeding points 15-1, 15-2, and 15-3 are respectively supplied with electrical signals which are different in at least one of amplitude and phase. The ground layer 12 includes end portions for the feeder conductors, an outer ring-like portion, and a center circular portion.

The three electricity feeding points are preferably arranged at regular intervals on the circumference of a concentric circle of the circular antenna element 11. Four or more electricity feeding points can be provided. The electricity feeding points may not be arranged at regular intervals. When four or more electricity feeding points are provided, they are not necessarily arranged on an identical circle.

Figure 2:
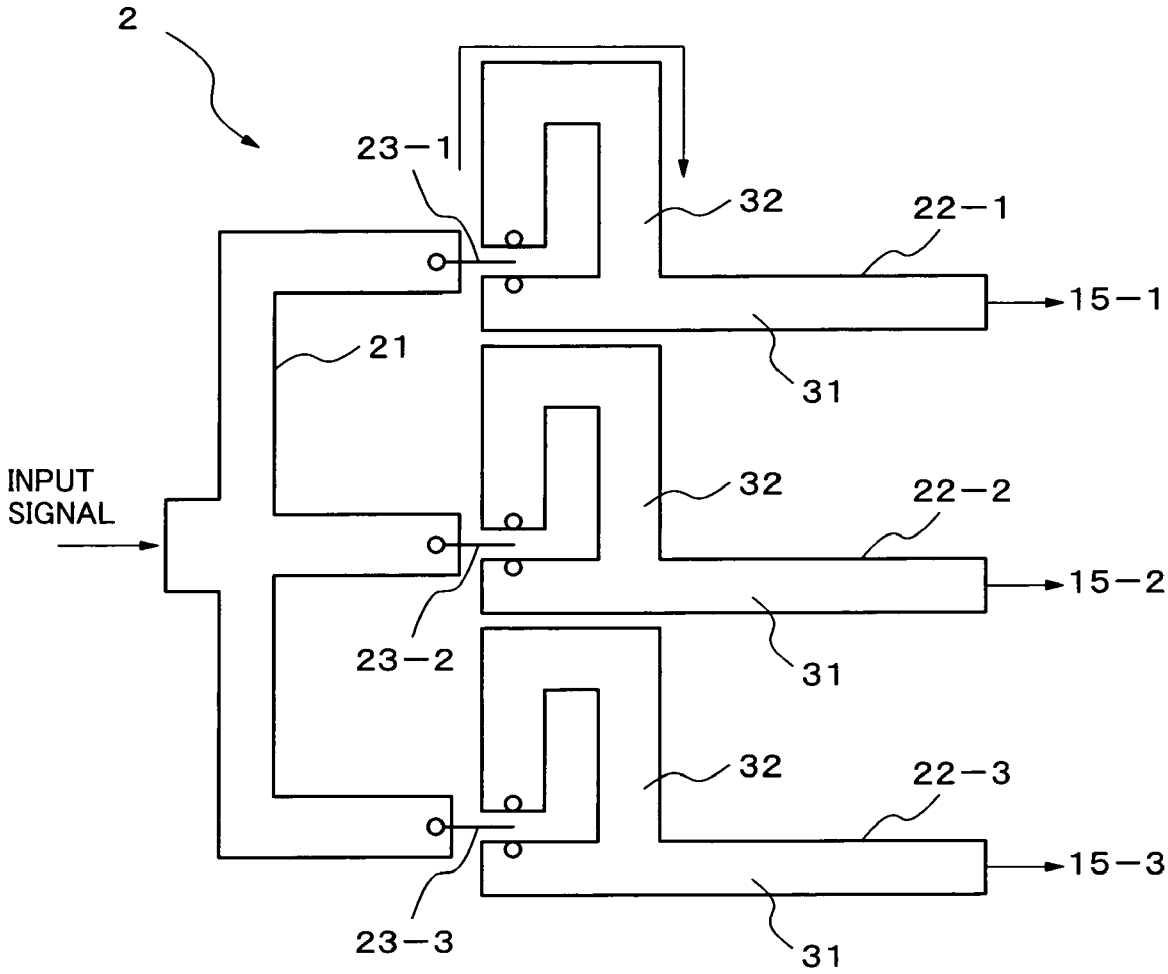
FIG. 2 shows a feeder circuit according to the embodiment of the present invention.

FIG. 2 shows the feeder circuit 2 according to this example. The feeder circuit 2 includes: a dividing conductor 21 for dividing an input electrical signal into three electrical signals to be transferred to electricity feeding points; strip lines 22-1, 22-2, and 22-3 for transferring the divided electrical signals to the three electricity feeding points, respectively; and phase switches 23-1, 23-2, and 23-3 for switching the phases of the electrical signals. The phase switches switch between a first path 31 and a second path 32. In this exemplary embodiment, for example, an electrical signal passing through the second path 32 has a phase delay of 180 degrees. However, the second path may cause different phase delays. As the phase switches, for example, single pole dual throw (SPDT) switches can be used. The phase switches are controlled by a control section (not shown).

FIG. 3 shows an operation example of the antenna device. In this operation example, the amplitude of each of three electrical signals input to the electricity feeding points is constant. Further, the phase of one electrical signal is delayed by 180 degrees compared with those of the other two electrical signals. Specifically, the electrical signal with its phase being delayed by 180 degrees is fed to the electricity feeding point 15-1 in a case 1, the electrical signal with its phase being delayed by 180 degrees is fed to the electricity feeding point 15-2 in a case 2, and the electrical signal with its phase being delayed by 180 degrees is fed to the electricity feeding point 15-3 in a case 3. As a result, the beam directions show 180 degrees in the case 1, 300 degrees in the case 2, and 60 degrees in the case 3.

Figure 4:
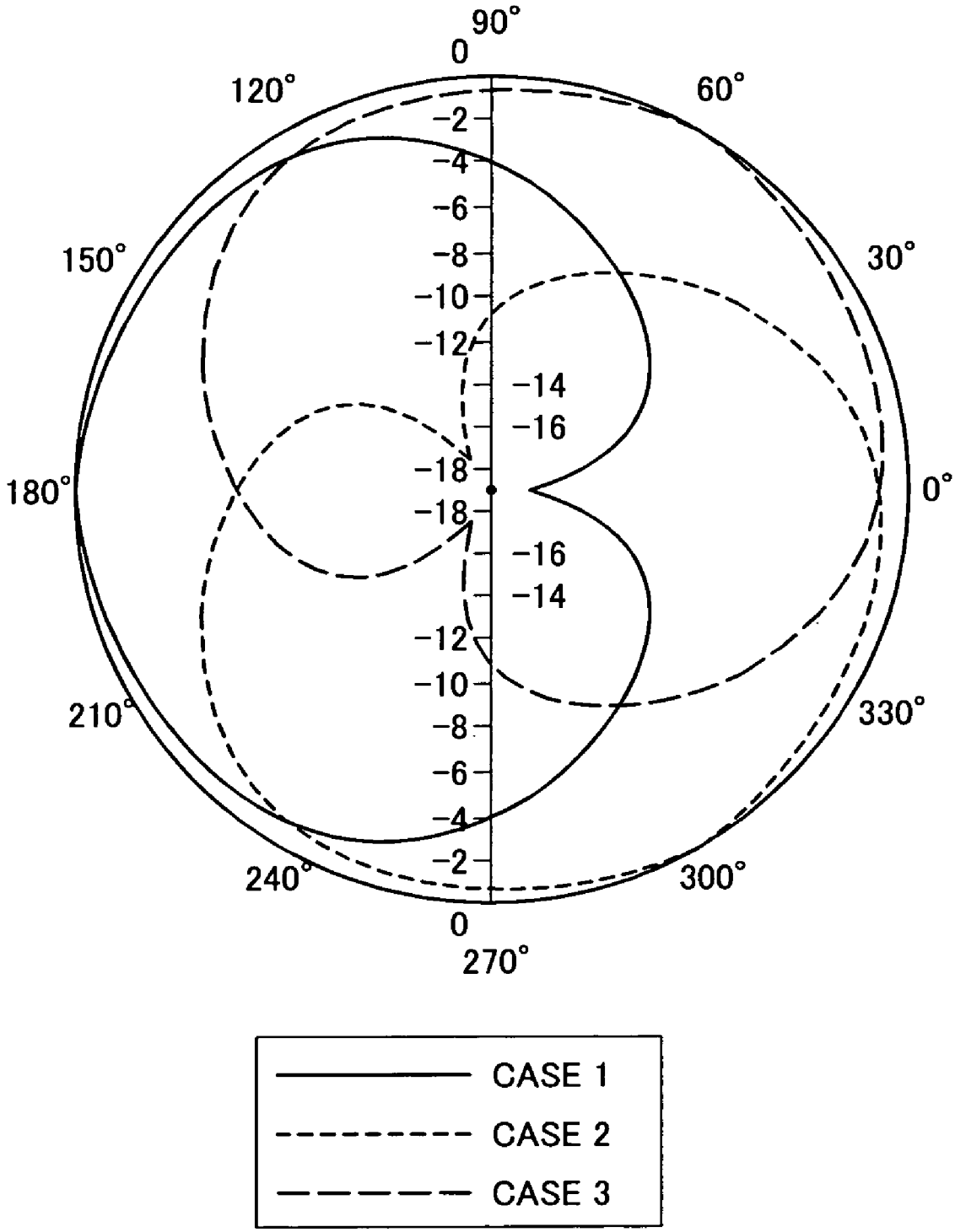
FIG. 4 shows radiation characteristics of the antenna device according to the embodiment of the present invention.

FIG. 4 shows simulation results of the radiation characteristics shown in FIG. 3 on the horizontal plane of the antenna device. FIG. 4 shows the radiation characteristics obtained when the center frequency is 2.3 GHz, a radius r1 of the antenna element 11 is 18 mm, a radius r2 of the cylindrical conductor 14 is 4 mm, a thickness h of the antenna main body 1 is 4 mm, and the dielectric constant of the dielectric layer 13 is 2.2. Those characteristics indicate that the antenna device according to the exemplary embodiment of the present invention can operate as a sector antenna having three sectors.

The feeder circuit 2 can switch the phase of an electrical signal according to at least one of the reception sensitivity, the signal quality, and the error rate of the signal received by the antenna device. To be more specific, the control section (not shown) monitors the reception sensitivity, the signal quality, and the error rate, controls the switches 23-1, 23-2, and 23-3 to improve those characteristics, and switches the phase of the electric signal to thereby obtain the optimal directivity. Such operations can improve the reception sensitivity and eliminate interferences caused by other terminals. When a terminal having the above-mentioned antenna device is a transceiver, a transmission characteristic (for example, a transmission power) corresponding to the reception characteristic of the antenna device can be obtained, and thus the transmission and reception characteristics are improved.

When an amount of the phase delay is set to be smaller than 180 degrees, the directivity can be finely changed. On the other hand, it is possible to change the amplitude of an electric signal while keeping the phases of the respective electrical signals constant. If many electricity feeding points are provided on an identical circle on the antenna element, the antenna main body may have any other shape besides a disc shape.

Figure 5:
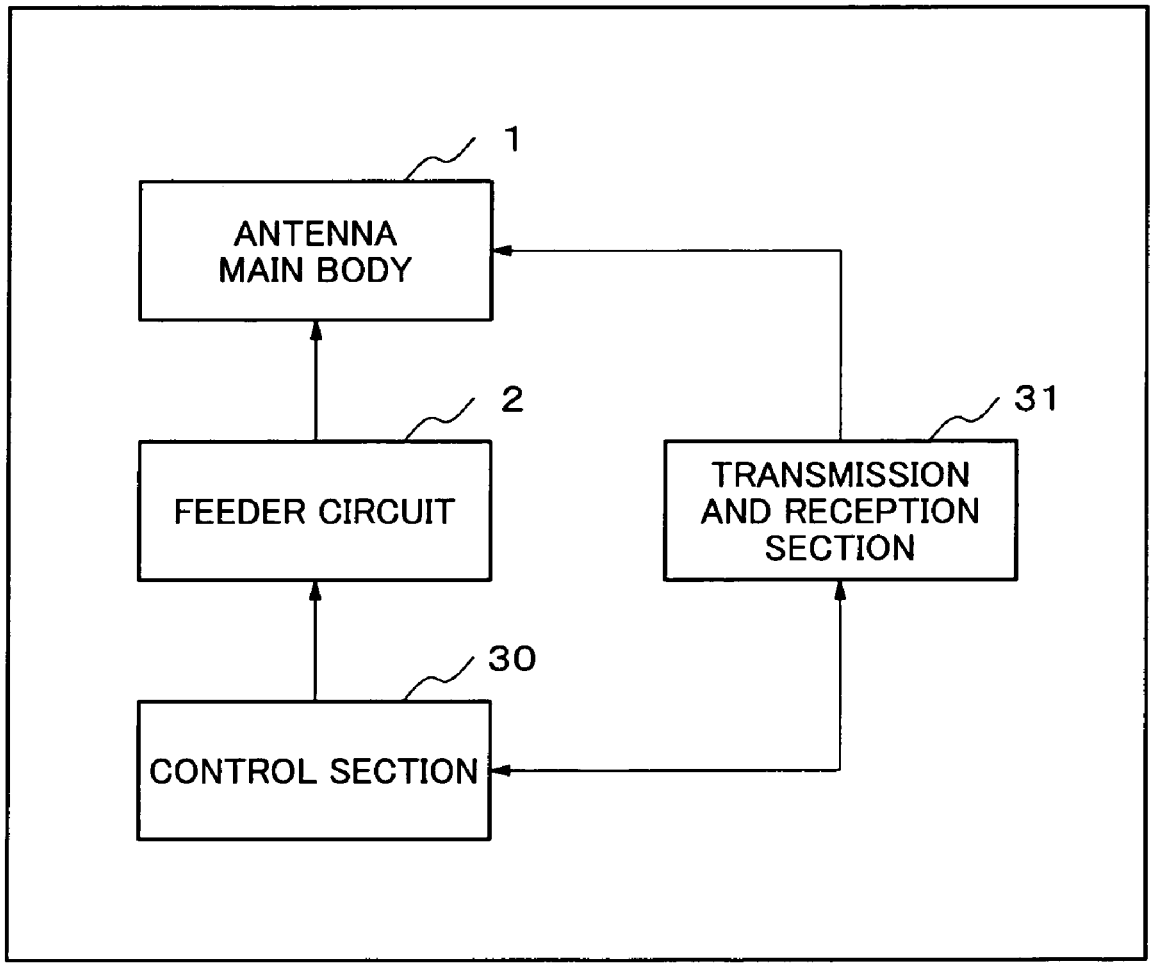
FIG. 5 is a block diagram of a radio communication apparatus according to the embodiment of the present invention.

The antenna device of the present invention can be applied to antennas to be provided for known cellular telephones, radio communication apparatuses for wireless local area networks, and communication apparatuses for radio frequency identification. The above radio communication apparatuses each have a control section 30 and a transmission and reception section 31 in addition to the above-described antenna main body 1 and feeder circuit 2, as illustrated in FIG. 5.

While the present invention has been described in connection with certain preferred embodiments, it is to be understood that the subject matter encompassed by the present invention is not limited to those specific embodiments. On the contrary, it is intended to include all alternatives, modifications, and equivalents as can be included within the spirit and scope of the following claims.

Further, it is the inventor's intent to retain all equivalents of the claimed invention even if the claims are amended during prosecution.

What is claimed is:

1. An antenna device, comprising:

an antenna main body having at least three electricity feeding points; and a feeder circuit for feeding an electrical signal to the antenna main body, wherein the feeder circuit includes a strip line for connecting each feeding point, the strip line having a first path and a second path, wherein the second path has a phase delay; and a switch which switches between the first path and the second path of said strip line, and wherein the feeder circuit feeds electrical signals different in at least one of amplitude and phase to the electricity feeding points, and wherein the antenna main body includes an antenna layer, a dielectric layer, a ground layer, a cylindrical conductor for electrically connecting a center part of the antenna layer to a center part of the ground layer, and conductors connected to the antenna layer at the electricity feeding points.

2. An antenna device according to claim 1, wherein the electricity feeding points are arranged on a circumference of an identical circle on the antenna main body.

3. An antenna device according to claim 2, wherein the electricity feeding points are arranged at regular intervals.

4. An antenna device according to claim 1, wherein the antenna main body is formed in a disc shape.

5. An antenna device according to claim 4, wherein the electricity feeding points are arranged on a circumference of a circle having the same center as the disc-shaped antenna main body.

6. An antenna device according to claim 1, wherein the feeder circuit includes at least one of an amplifier, an attenuator, and a phase switching device.

7. An antenna device according to claim 6, wherein the phase switching device switches one of an amplitude and a phase of an electrical signal according to one of a reception sensitivity, a signal quality, and an error rate thereof.

8. An antenna device according to claim 1, wherein the feeder circuit performs beam steering in a horizontal surface plane of the antenna device.

9. An antenna device according to claim 1, wherein the conductors connected to the antenna layer at the electricity feeding points are not connected to the ground layer.

* * * * *